US005121661A

United States Patent [19]

Deplante et al.

[11] Patent Number: 5,121,661

[45] Date of Patent: Jun. 16, 1992

[54] TOOL FOR REMOVING CONTAINER COVERS

[76] Inventors: Harold Deplante, 3625 Hazelwood Ct., Colorado Springs, Colo. 80918; Richard Kedrowski, 26 Riverside Ct., Avon, Colo. 81620

[21] Appl. No.: 693,139

[22] Filed: Apr. 29, 1991

[51] Int. Cl.[5] ..... B67B 7/44

[52] U.S. Cl. ..... 81/3.09; 81/3.55; 7/151

[58] Field of Search ..... 7/105, 151, 166; 81/3.09, 3.55, 3.57, 3.07

[56] References Cited

U.S. PATENT DOCUMENTS

| | | | |
|---|---|---|---|
| 2,669,143 | 2/1954 | Bradbury . | |
| 3,872,745 | 3/1975 | Garza et al. . | |
| 4,216,685 | 8/1980 | Taylor | 81/3.55 |
| 4,234,988 | 11/1980 | Ross et al. | 7/151 |
| 4,463,631 | 8/1984 | Barnes et al. . | |
| 4,492,132 | 1/1985 | Obey . | |
| 4,580,302 | 4/1986 | Barth . | |
| 4,631,769 | 12/1986 | White . | |
| 4,747,173 | 5/1988 | Marceau | 81/3.55 |
| 4,757,568 | 7/1988 | Jones . | |
| 4,829,619 | 5/1989 | Edgerton . | |

FOREIGN PATENT DOCUMENTS

| | | | |
|---|---|---|---|
| 2508025 | 9/1976 | Fed. Rep. of Germany | 81/3.57 |

*Primary Examiner*—Roscoe V. Parker

*Attorney, Agent, or Firm*—Klaus, Law, O'Meara & Malkin

[57] ABSTRACT

A tool for removing the cover from a five gallon plastic or metallic container which tool has a lever portion, a handle portion at one end of the lever portion and an actuating member secured to the other end of the lever portion wherein the actuating member has a portion for removing a plastic cover and another portion for removing a metallic cover.

18 Claims, 2 Drawing Sheets

TOOL FOR REMOVING CONTAINER COVERS

FIELD OF THE INVENTION

This invention relates generally to a tool for removing covers from containers and more particularly to a tool for removing plastic or metal covers from five gallon paint containers.

BACKGROUND OF THE INVENTION

There are many different tools provided for removing lids from all sizes of containers. In the field of paint containers, paint is marketed in five gallon containers which have metallic covers or plastic covers thereon. The metallic cover has a top portion and a securing portion which generally comprises a plurality of integral tabs extending outwardly from the tab portion and which are crimped over the rolled peripheral rim of the container. Each of the tabs has an opening formed therein so that a tool can be inserted to pry up the tab. The plastic cover is an integral member having a top portion and a depending side portion that fits snugly over the rim of the container. A plurality of circumferentially spaced apart closed end slots are formed in the side portion extending from a narrow continuous end portion of the side portion. This type of lid is generally opened by severing the narrow portion adjacent to each of the closed end slots. Therefore, it is desirable to have a tool for removing the metallic lid or the plastic lid from a five gallon paint container.

BRIEF DESCRIPTION OF THE INVENTION

This invention provides a tool for removing either a plastic cover or a metallic cover from a five gallon paint container.

In a preferred embodiment of the invention, there is provided a tool for opening and removing a cover mounted in sealed relationship on a container which tool comprises an actuating member for engaging the cover; a lever portion extending upwardly from the actuating member; a handle portion integral with the lever portion; a plastic cover removing means on the actuating member for use in removing a plastic cover from a container and a metallic cover removing means on the actuating member for use in removing a metallic cover from the container. The lever portion extends in a first linear direction and the handle portion extends in a second linear direction that is inclined relative to the first linear direction. The included angle between the first and second linear directions is between about one hundred and forty and one hundred and sixty degrees and preferably about one hundred and fifty degrees. The lever portion and the handle portion are formed from rectangular tubing, preferably square hollow tubing, made from a suitable metallic material, such as steel. The plastic cover removing means and the metallic cover removing means are integral and are secured to the lever portion by suitable means, such as by welding. The plastic cover removing means comprise a base portion secured to the lever portion and projecting outwardly therefrom; a hook portion integral with the base portion and extending in a direction toward the handle portion and the hook portion is spaced outwardly from the lever portion. The angular relationship between the base portion and the hook portion is less than ninety degrees and preferably is between about 20 and 40 degrees and particularly about 30 degrees. The metallic cover opening means comprise a tang portion integral with the base portion and extending therefrom in a direction opposite to the direction of the extent of the hook portion. The base portion has opposite edge portions, an upper surface and a lower surface. The hook portion extends upwardly from the upper surface along one of the opposite edge portions and the tang portion extends downwardly from the lower surface from a portion of the opposite edge portion. The tang portion has an abutment fulcrum surface for contacting the side of the container.

When the tool is used to open and remove a plastic cover, the hook portion is inserted between the side of the container and the side portion of the cover at a location between a pair of the circumferentially spaced apart closed end slots. The handle portion is pivoted while an upwardly directed force is applied thereto and through the lever portion causes the top portion of the hook portion to bear against the side of the container and the bottom portion to bear against the side portion of the cover to apply an outwardly directed force on the portion of the side portion between the pair of circumferentially spaced apart closed end slots to break the narrow portion and move that portion of the side portion radially outwardly. This is repeated until all of the side portion has been moved radially outwardly. When the tool is used to open and remove a metallic cover, the tank portion is inserted through the opening in one of the tabs and the handle portion is pivoted while a downwardly directed force is applied thereto and through the lever portion forces the abutment fulcrum surface of the tang portion to bear against the side of the container and the other surface of the tang portion bears against the tab to move the tab radially outwardly. This operation is repeated with the remaining tabs so that the metallic cover may be easily removed.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
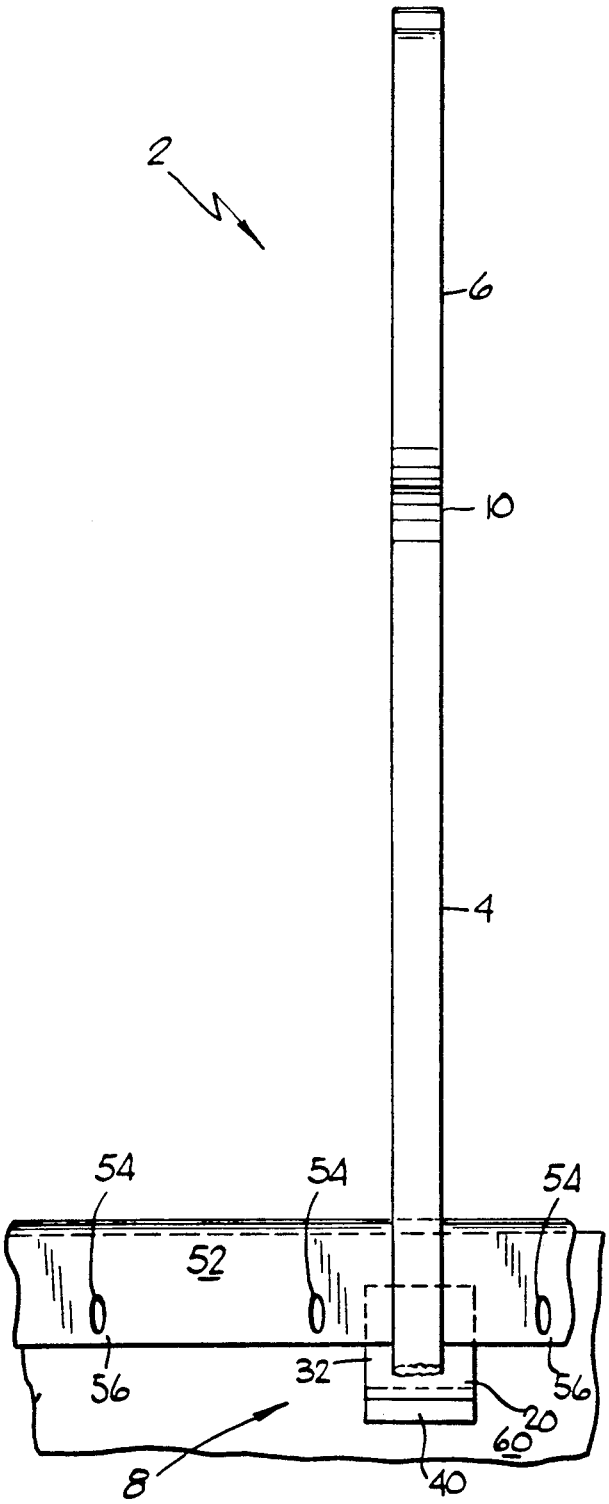
FIG. 1 is an elevational view of the tool being used to open a plastic cover.

The tool 2 comprises an elongated lever portion 4, an elongated handle portion 6 and an actuating portion 8. The lever portion 4 and the handle portion 6 are preferably formed from a metallic material, such as metal, and preferably comprise 0.50 inch square tubing having a wall thickness of between about 0.03125 and 0.094 inch and preferably of about 0.062 inch. A bend 10 is integral with the elongated lever portion 4 and the elongated handle portion 6 and has an included angle A of between about 140 and 160 degrees and preferably of about 150 degrees. The elongated lever portion 4 has an effective length of between about 7.0 and 8.0 inches and preferably of about 7.375 inches and the elongated handle portion 6 has an effective length of between about 4.0 and 5.0 inches and preferably of about 4.25 inches. If desired, a rubber hand grip (not shown) can be placed over the elongated handle portion 6.

The actuating portion 8 comprises a base member 20 which is secured to the end 22 of the lever portion 4 by suitable means, such as by welding. The angle B between the elongated lever portion 4 and the base member 20 preferably is about 90 degrees. The base member 20 is formed from a metallic material, such as steel and has a length of about 1.0 inch, a width of about 1.0 inch and a thickness of about 0.125 inch. The base member 20 has opposite edge portions 24 and 26, an upper surface 28 and a lower surface 30.

The actuating portion 8 includes plastic cover removing means which comprise an integral hook portion 32 that extends upwardly from the upper surface 28 along the edge portion 24. The hook portion 32 has a width corresponding to the width of the base member 20 and extends upwardly for a distance of about 1.0 inch. The angle C between the base member 20 and the hook portion 32 is between about 1.0 and 3.0 degrees and preferably is about 2.0 degrees. If desired, the end portion 34 of the hook portion 32 can be of a gradually reduced thickness to provide a tapered end portion (not shown).

The actuating portion 8 includes metallic cover removing means which comprise an integral tang portion 40 which extends downwardly from the lower surface 30 along the edge portion 26. The tang portion 40 has a width that is between about 0.25 and 0.50 inch and preferably of about 0.375 inch and is located centrally of the edge portion 26. The tang portion 40 extends downwardly for a distance of between about 0.375 and 0.50 inch and preferably of about 0.440 inch. The end portion 42 is gradually reduced in thickness so as to provide a tapered portion.

Figure 2:
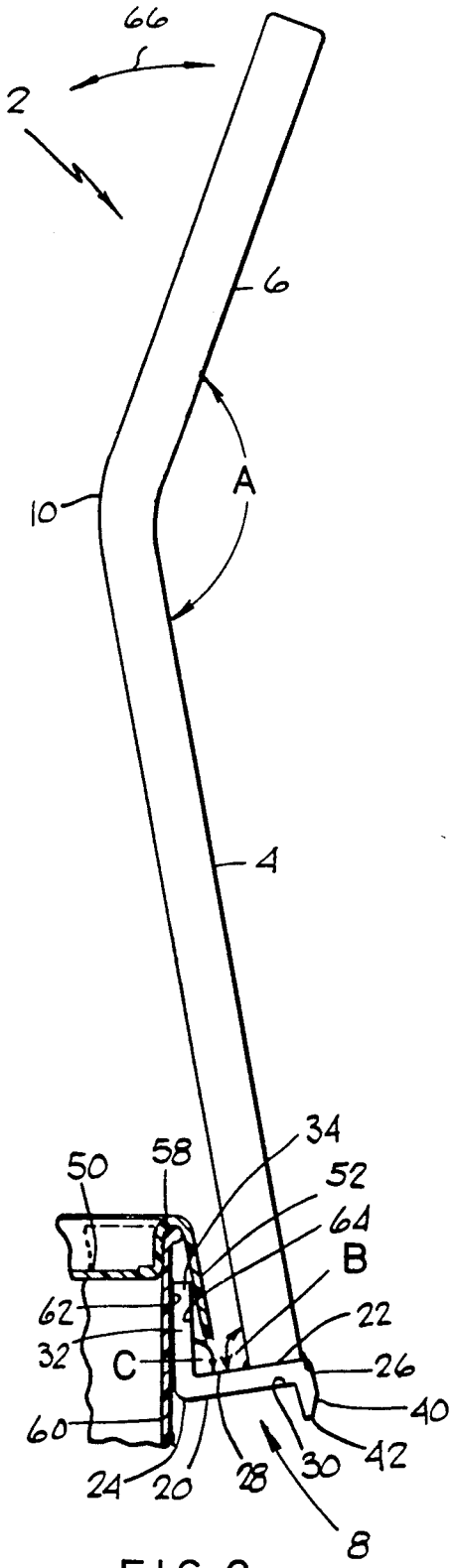
FIG. 2 is an elevational view with parts in section from the left side of FIG. 1.

In FIGS. 1 and 2, the tool 2 is illustrated as it is being used to remove a plastic cover 50 having a side portion 52. As illustrated in FIG. 1, the side portion 52 is provided with a plurality of circumferentially spaced apart slots 54 so as to leave a continuous narrow band 56. The plastic cover 50 is seated on the rolled end portion 58 of the side 60 of a container, such as a plastic five gallon paint container (not shown). The end portion 34 is inserted between the side 60 and the side portion 52 at a location between a pair of adjacent closed end slots 54 so that the surface 62 faces the side 60 and the surface 64 faces the side portion 52. The handle portion 6 is moved in reciprocating movements in the directions indicated by the arcuate arrows 66 while applying an upwardly directed force thereto to gradually move the side portion 52 radially outwardly from the side 60. As the handle portion 6 is moved, a portion of the surface 62 bears against the side 60 and a portion of the surface 64 bears against the side portion 52. When the side portion 52 has moved through a first distance, the force applied by the hook portion functions to break the narrow bands 56 adjacent the slots 54, so that this portion of the side portion 52 may be moved completely away from the side 60. This operation is repeated between each pair of adjacent slots 54 until the entire side portion 52 has been moved completely away from the side 60 so that the cover 50 may be easily removed.

Figure 3:
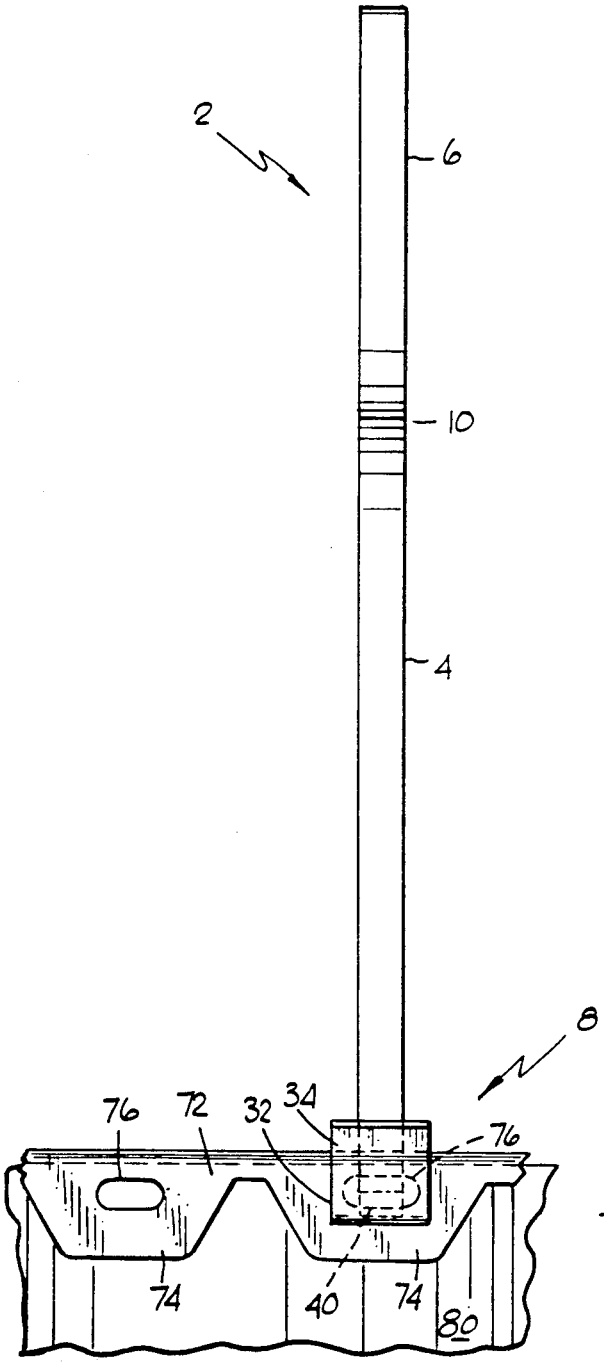
FIG. 3 is an elevational view of the tool being used to open a metallic cover.
Figure 4:
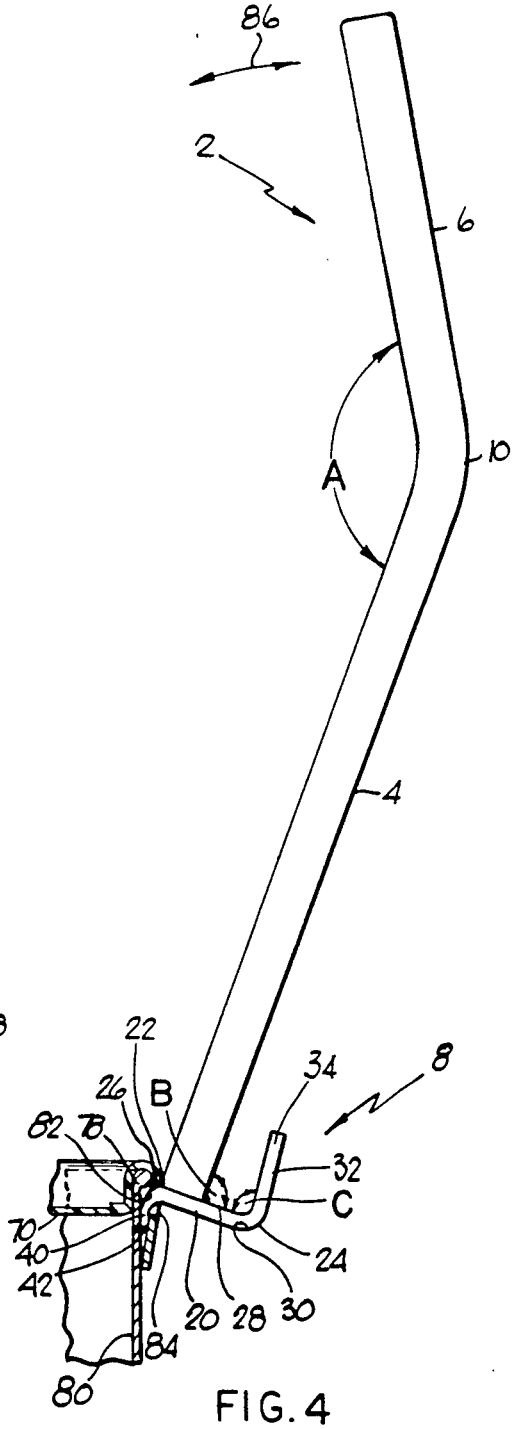
FIG. 4 is an elevational view with parts in section from the left side of FIG. 3.

In FIGS. 3 and 4, the tool 2 is illustrated as it is being used to remove a metallic cover 70 having a side portion 72. As illustrated in FIG. 3, the side portion 72 has a plurality of circumferentially spaced apart tab portions 74 each having an opening 76 formed therein. The metallic cover 70 is seated on the rolled end portion 78 of the side 80 of a container, such as a metallic five gallon paint container (not shown). The tab portions 74 are spaced a slight distance from the side 80 so that the tapered end portion 42 of the tang portion 40 may be inserted through the openings 76. After the tapered end portion 42 has been inserted through one of the openings 76, so that an abutment fulcrum surface 82 faces the side 80 and a surface 84 faces the side portion, the handle portion 6 is moved in reciprocating movements in the directions indicated by the arcuate arrows 86 while applying a downwardly directed force to gradually move the tab portion 74 away from the side 80. As the handle portion 6 is moved, a portion of the surface 82 bears against the side 80 and a portion of the surface 84 bears against the side portion 70. After on tab portion 74 has been moved the desired distance from the side 80, the operation is repeated on the next adjacent tab portion 74 until all of the tab portions 74 have been moved the desired distance from the side 80 so that the metallic cover 70 may be easily removed.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A tool for opening and removing a cover mounted in sealed relationship on a container having at least a side portion comprising:
   - a Z-shaped actuating member for engaging the cover;
   - an elongated lever portion extending upwardly from the intermediate portion of the Z-shaped actuating member;
   - an elongated handle portion at the other end of said elongated lever portion;
   - a plastic cover removing means at one end of said Z-shaped actuating member for use in removing a plastic cover from a container;
   - a metallic cover removing means at the other end of said Z-shaped actuating member for use in removing a metallic cover from a container;
   - said elongated lever portion extends in a first linear direction; and
   - said elongated handle portion extends in a second linear direction that is inclined relative to the first linear direction.

2. The invention as in claim 1 wherein:
   - the included angle between said first and second linear directions is between about one hundred and forty and one hundred and sixty degrees.

3. A tool for opening and removing a cover mounted in sealed relationship on a container having at least a side portion comprising:
   - a Z-shaped actuating member for engaging the cover;
   - an elongated lever portion extending upwardly from the intermediate portion of the Z-shaped actuating member;
   - an elongated handle portion at the other end of said elongated lever portion;
   - a plastic cover removing means at one end of said Z-shaped actuating member for use in removing a plastic cover from a container;
   - a metallic cover removing means at the other end of said Z-shaped actuating member for use in removing a metallic cover from a container; and said elongated lever portion and said elongated handle portion each have a rectangular transverse cross-sectional configuration.

4. The invention as in claim 3 wherein:

said rectangular transverse cross-sectional configuration is a square.

5. A tool for opening and removing a cover mounted in sealed relationship on a container having at least a side portion comprising:

a Z-shaped actuating member for engaging the cover;

an elongated lever portion extending upwardly from the intermediate portion of the Z-shaped actuating member;

an elongated handle portion at the other end of said elongated lever portion;

a plastic cover removing means at one end of said Z-shaped actuating member for use in removing a plastic cover from a container;

a metallic cover removing means at the other end of said Z-shaped actuating member for use in removing a metallic cover from a container; and said elongated lever portion and said elongated handle portion are formed from hollow, metallic tubing.

6. The invention as in claim 5 wherein said plastic cover removing means comprise:

a base portion projecting outwardly from said elongated lever portion;

a hook portion integral with said base portion and extending in a direction toward said elongated handle portion; and said hook portion being spaced from said elongated lever portion.

7. The invention as in claim 6 wherein:

the angular relationship between said base portion and said hook portion is less than ninety degrees.

8. The invention as in claim 5 wherein said metallic cover removing means comprise:

a tang portion extending from said Z-shaped actuating member in a direction away from said elongated handle portion.

9. The invention as in claim 8 wherein:

said tang portion has a narrow end portion and an abutment fulcrum surface for contacting the side portion of said container.

10. The invention as in claim 1 wherein:

said plastic cover removing means and said metallic cover removing means are integral and are attached to said elongated lever portion.

11. The invention as in claim 10 wherein said plastic cover removing means comprise:

a base portion secured to said elongated lever portion and projecting outwardly therefrom;

a hook portion integral with said base portion and extending in a direction toward said elongated handle portion; and said hook portion being spaced from said elongated lever portion.

12. The invention as in claim 11 wherein:

the angular relationship between said base portion and said hook portion is less than ninety degrees.

13. The invention as in claim 11 wherein said metallic cover removing means comprise:

a tang portion integral with said base portion and extending from said base portion in a direction opposite to the extent of s id hook portion.

14. The invention as in claim 13 wherein:

said tang portion has a narrow end portion and an abutment fulcrum surface for contacting the side portion of said container.

15. The invention as in claim 13 wherein:

said base portion having opposite side portions;

said hook portion being integral with one side portion; and said tang portion being integral with the opposite side portion.

16. The invention as in claim 15 wherein:

said base portion having an upper surface and a lower surface; and said elongated lever portion being secured to said upper surface.

17. The invention as in claim 16 wherein:

said upper surface having an area greater than the area of the transverse cross-sectional configuration of said elongated lever portion.

18. The invention as in claim 17 wherein:

said elongated lever portion extends in a first linear direction; and said elongated handle portion extends in a second linear direction that is inclined relative to the first linear direction.

* * * * *